US007470127B2

(12) United States Patent
Chen et al.

(10) Patent No.: US 7,470,127 B2
(45) Date of Patent: Dec. 30, 2008

(54) ELECTRICAL CONNECTOR ASSEMBLY

(75) Inventors: Ming-Ching Chen, Tu-Cheng (TW); Xing-Jun Cheng, Shenzhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/505,715

(22) Filed: Aug. 17, 2006

(65) Prior Publication Data

US 2007/0042621 A1 Feb. 22, 2007

(30) Foreign Application Priority Data

Aug. 17, 2005 (CN) ..... 2005 2 0074744 U

(51) Int. Cl.
*H01R 12/00* (2006.01)

(52) U.S. Cl. ..... 439/65

(58) Field of Classification Search ..... 439/65, 439/74, 83, 81, 660, 680, 157
See application file for complete search history.

(56) References Cited

U.S. PATENT DOCUMENTS 5,504,647 A * 4/1996 Kuriyama ..... 361/534
6,500,013 B1 12/2002 Wang
6,623,308 B2 * 9/2003 Ono ..... 439/680
6,764,314 B1 * 7/2004 Lee ..... 439/65

* cited by examiner

*Primary Examiner*—Alexander Gilman
(74) *Attorney, Agent, or Firm*—Wei Te Chung

(57) ABSTRACT

An electrical connector assembly (1000) includes a first connector (100) having a first housing (1) and a plurality of first terminals (2) fitted in the first housing (1) and a second connector (200) having a second housing (4) and a plurality of second terminals (5) fitted in the second housing (4). The first housing (2) comprises a longitudinal main body (11) defining a receiving space (110) and a plurality of first receiving slots (115) arranged along the longitudinal direction. The first terminals (2) are received in the first receiving slots (115). The second housing (4) comprises a longitudinal base (40) received in the receiving space (110) of the first connector (1) and a plurality of second receiving slots (41) arranged along the longitudinal direction to receive the second terminals (5). The receiving space (110) of the first housing (1) comprises a plurality of receiving sections (116) arranged along longitudinal direction, the second housing (4) of the second connector (200) comprises a plurality of engaging portions (45) arranged corresponding to the receiving sections (116), the engaging sections (45) are received and retained in the receiving sections (116).

19 Claims, 9 Drawing Sheets

ELECTRICAL CONNECTOR ASSEMBLY

BACKGROUND OF THE INVENTION

1. Field of the Invention

The present invention generally relates to an electrical connector assembly, and more particularly to a micro coaxial connector assembly.

2. Description of Related Art

Electrical connector assembly are widely used to connect components. Please refer to the U.S. Pat. No. 6,500,013, such a connector usually comprises a plug connector and a receptacle connector. The plug connector comprises a first insulative housing, a plurality of terminals received in the first insulative housing, a cable electrically connecting with the plurality of terminals and a metal shell enclosing the first insulative housing. The receptacle connector used to be mounted on a print circuit board comprises a second insulative housing, a plurality of second terminals received in the second insulative housing and a second metal shell enclosing the second insulative housing. The plug connector inserts into the receptacle connector with the first terminals electrically connecting with the second terminals.

However, with the trend to minimize the size of electric or electrical connector and demand higher electric properties thereof, the plug connector and the receptacle connector become more smaller and smaller, and the engagement between the two connectors is not reliable when the cable is exerted by an upright force. In some circumstances, the plug connector will be overturned by additional exerted force, thus it will affect the stabilization of the electrical connection.

Hence, an improved electrical connector assembly is needed to overcome the disadvantages of the related art.

SUMMARY OF THE INVENTION

Accordingly, an object of the present invention is to provide an electrical connector assembly comprises a anti-overturn structure as well as maintaining a low profile and low cost.

In order to achieve the object set forth, an electrical connector assembly in accordance with present invention comprises a first connector having a first housing and a plurality of first terminals fitted in the first housing and a second connector having a second housing and a plurality of second terminals fitted in the second housing. The first housing comprises a longitudinal main body defining a receiving space and a plurality of first receiving slots arranged along the longitudinal direction. The first terminals are received in the first receiving slots. The second housing comprises a longitudinal base received in the receiving space of the first connector and a plurality of second receiving slots arranged along the longitudinal direction to receive the second terminals. The receiving space of the first housing comprises a plurality of receiving sections arranged along longitudinal direction, the second housing of the second connector comprises a plurality of engaging portions arranged corresponding to the receiving sections, the engaging sections are received and retained in the receiving sections.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
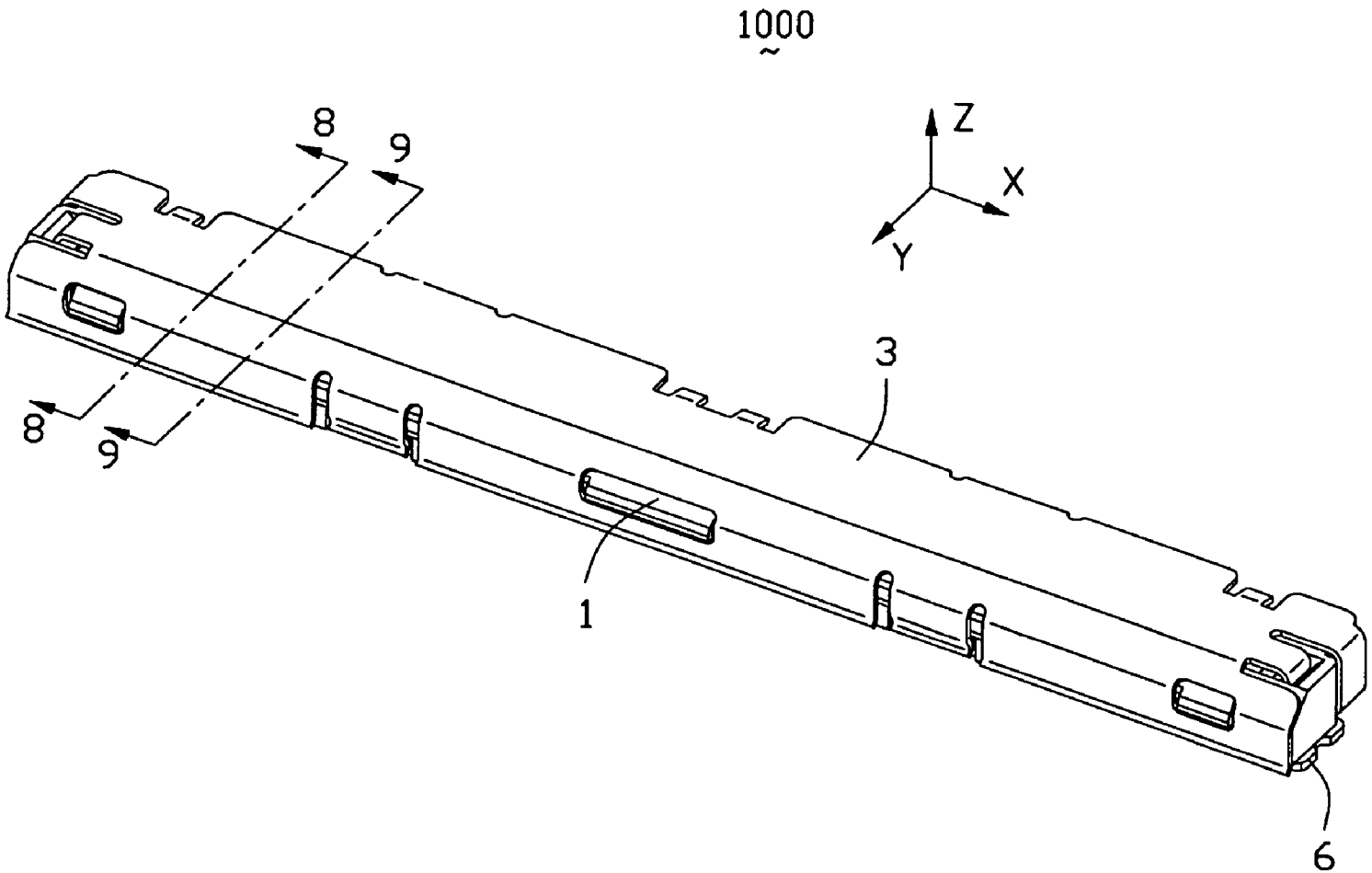
FIG. 1 is an assembled, perspective view of an electrical connector assembly in accordance with the present invention.
Figure 2:
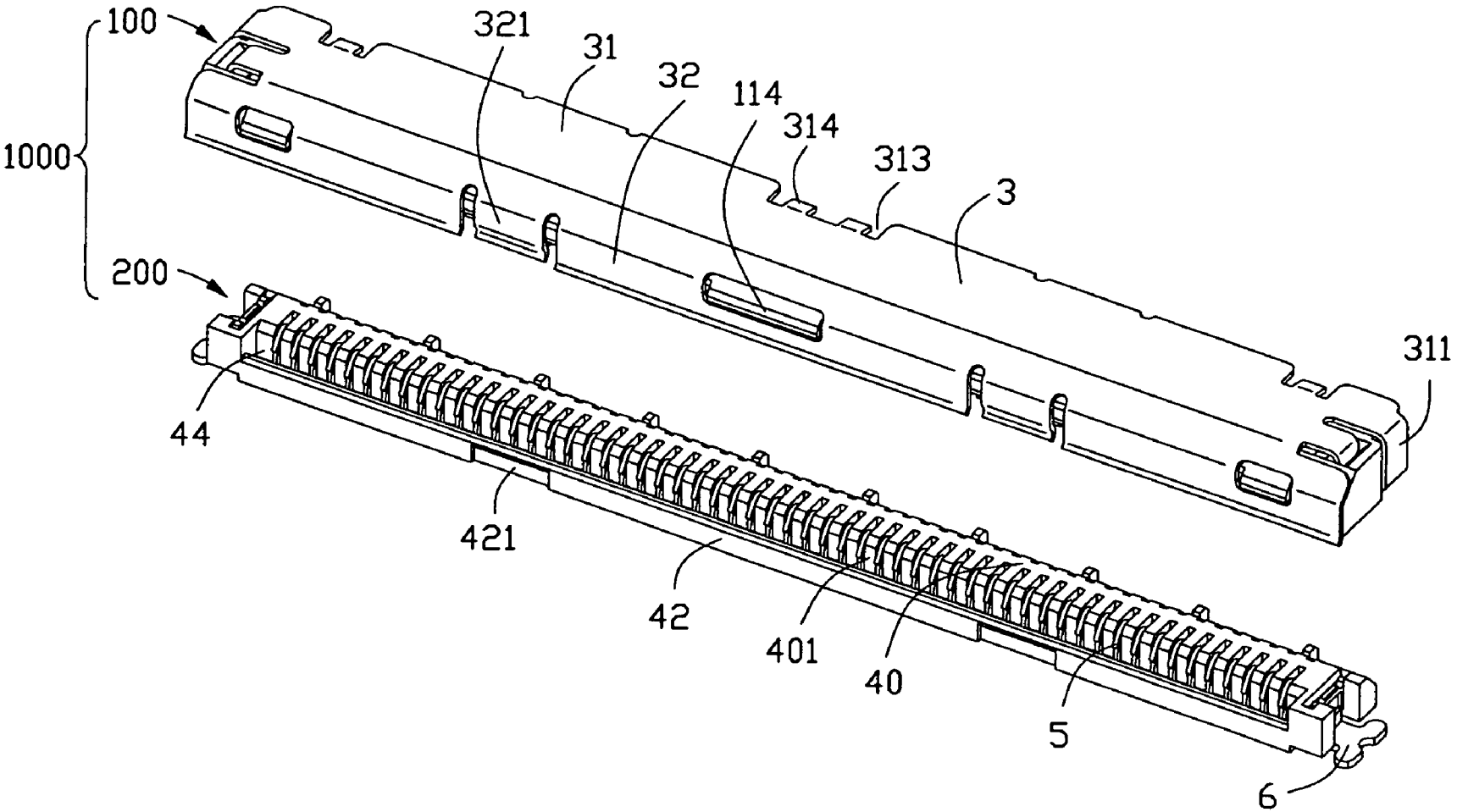
FIG. 2 is an exploded, perspective view of the electrical connector assembly shown in FIG. 1, illustrating a first connector and a second connector thereof.
Figure 3:
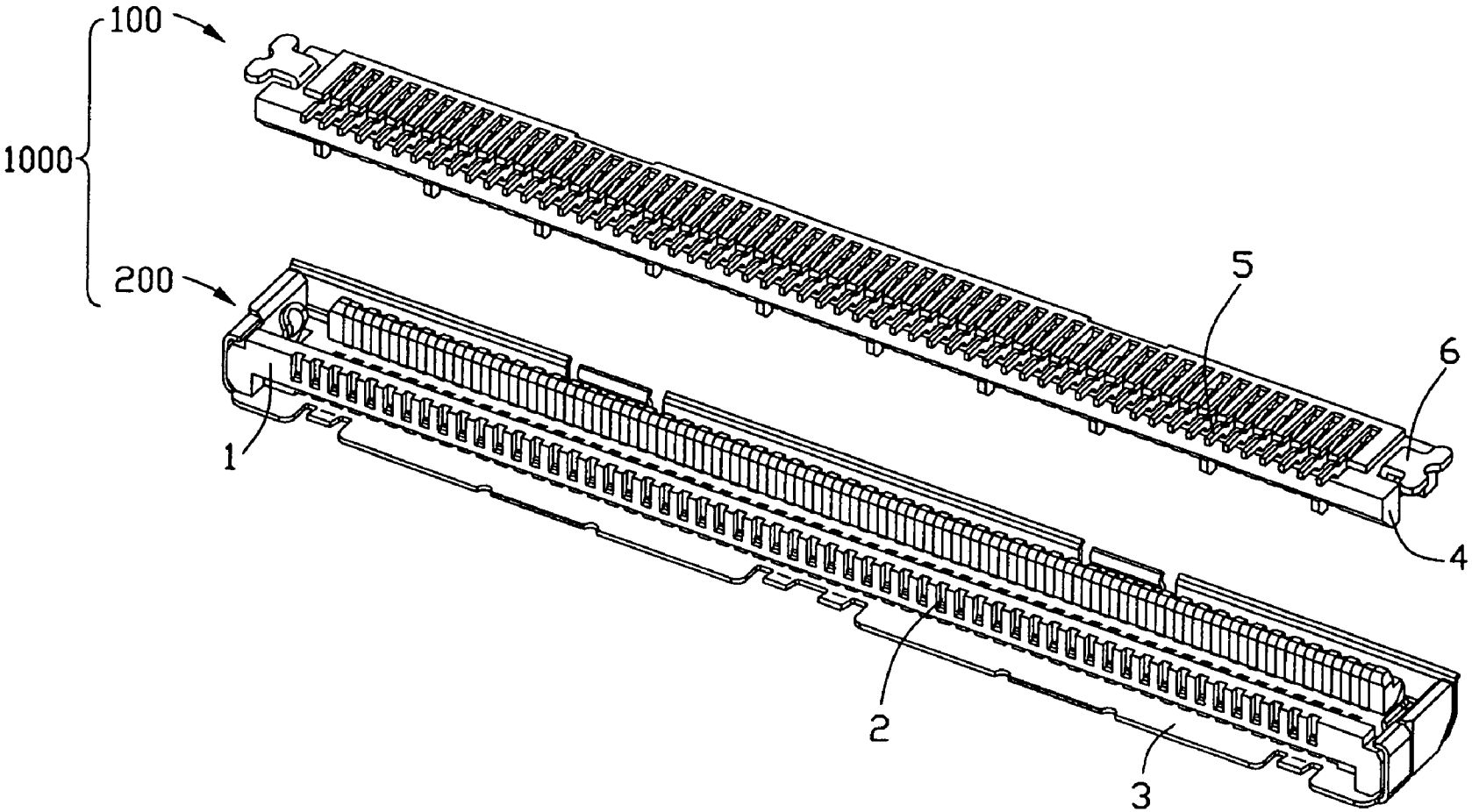
FIG. 3 is a view similar to FIG. 2, but taken from a different aspect.

Referring to FIGS. 1-3, an electrical connector assembly 1000 in accordance with the present invention comprises a first connector 100 and a second connector 200 mating with the first connector 100. In preferred embodiment, X, Y and Z are respectively designated to the front, right and up directions.

Figure 4:
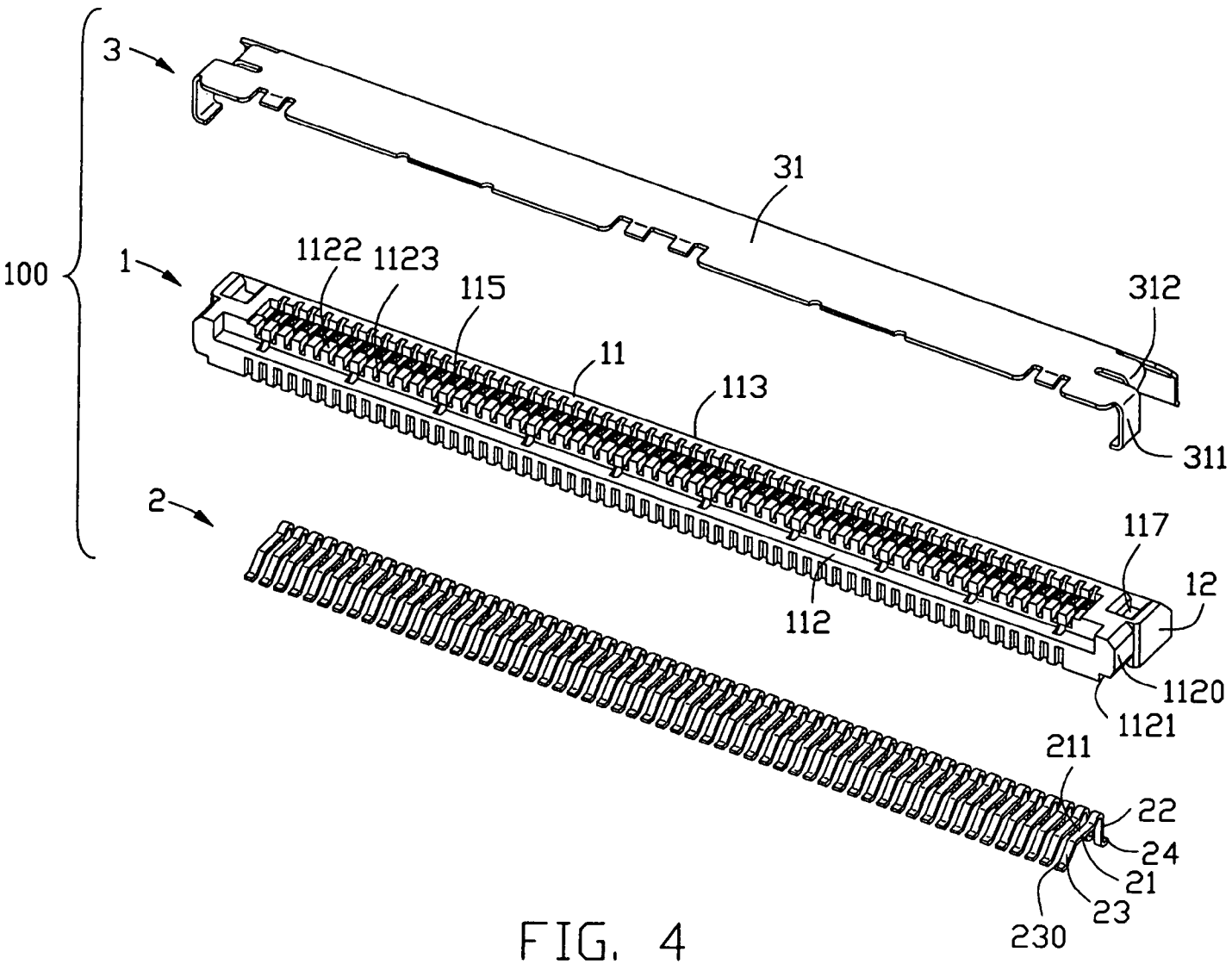
FIG. 4 is an exploded, perspective view of the first connector shown in FIGS. 2 and 3.
Figure 5:
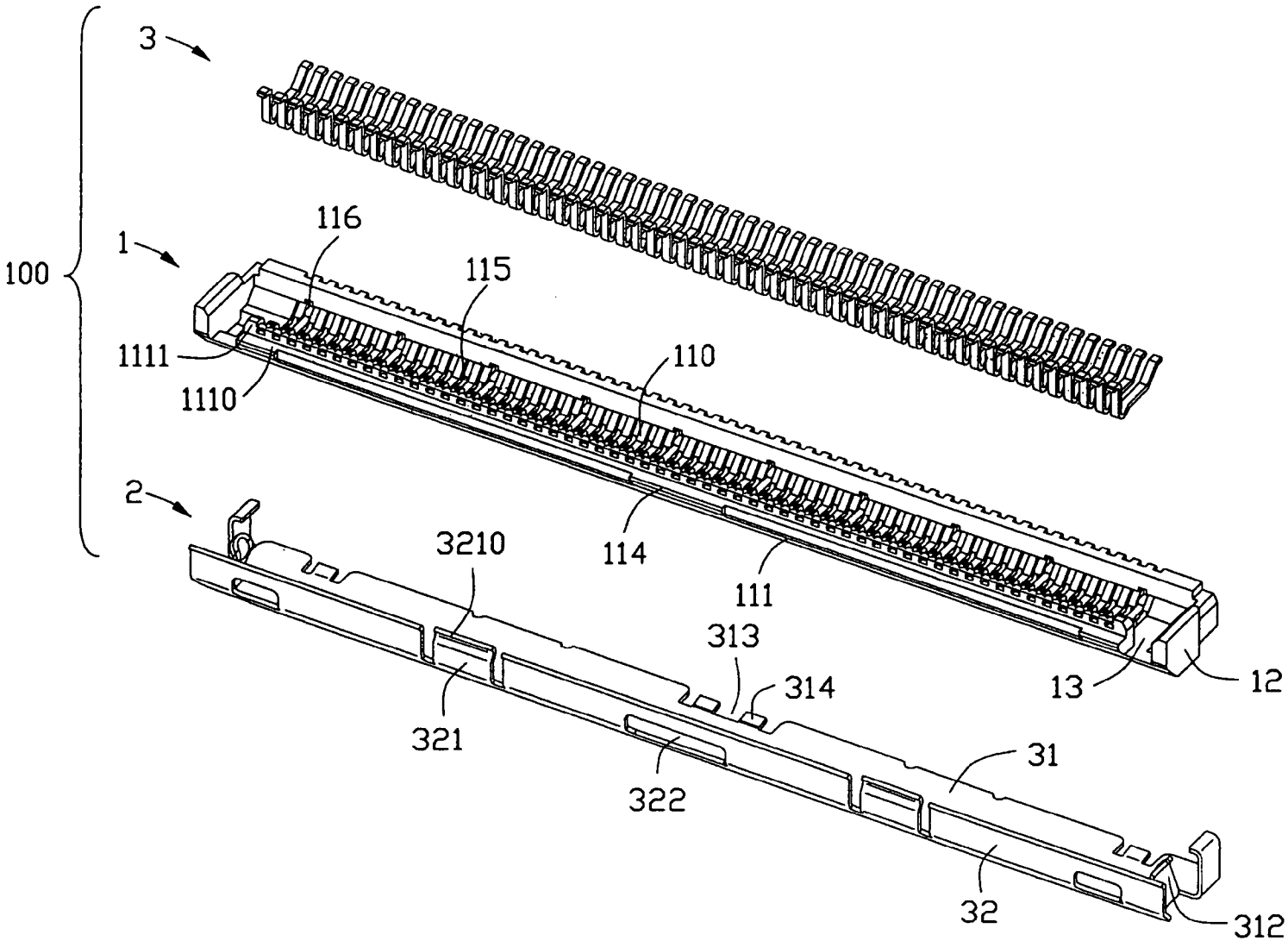
FIG. 5 is a view similar to FIG. 4, but taken from a different aspect.

Referring to FIGS. 4-5 and in conjunction with FIGS. 2-3, the first connector 100 comprises a first housing 1, a plurality of first terminals 2 received in the first housing 1 and a shield member 3 enclosing the first housing 1.

The first housing 1 is of longitudinal shape, and comprises a main body 11 and two side walls 12 disposed at two distal ends of the main body 11. Each side wall 12 and the main body 11 together define a notch 13 at distal end of the main body 11. The main body 11 is approximately of U-shape, and comprises a front wall 111, a rear wall 112 opposite to the front wall 111, an upper wall 113 connecting with the front wall 111 and the rear wall 112, and the walls 111, 112 and 113 together define a receiving space 110. The front wall 111 forms a plurality of wedges 114 on a front edge thereof, the rear wall 112 forms a pair of protrusions 1120 respectively extending transversely thereof, and each protrusion 1120 and the rear wall 112 together define a slit 1121. The upper wall 113 further forms a pair of windows 117 adjacent to the side walls 12, and the windows 117 respectively communicate with the notch 13 in up-to-down direction. Particularly referring to FIG. 9, the front wall 111 defines a recess 1110 at front side thereof and a projection 1111 at bottom thereof corresponding to the recess 1110. The upper wall 113 defines a plurality of heaves 1122 in a middle area thereof and aligned along longitudinal direction thereof, and each two adjacent heaves 1122 together define a receiving passageway 1223 for receiving a cable (not shown). The receiving space 110 defines a plurality of first receiving slots 115 corresponding to the receiving passageways 1123 and extending along the Y direction and arranged at intervals along the X direction. In addition, the first receiving slots 115 extend to the rear wall 112 and communicate with the rear wall 112. The rear wall 112 of the first housing 1 defines a plurality of receiving sections 116 disposed between the first receiving slots 115 at intervals. In preferred embodiment the receiving sections 116 are receiving slots.

The first terminals 2 are configured as L-shaped, and each comprises a first soldering portion 21 extending horizontally, a mating portion 22 extending downwardly, a retaining foot 24 bending horizontally and extending forwardly from the mating portion 22 and a retaining portion 23 bending obliquely and extending rearward from the soldering portion 21. The soldering portion 21 has a flat soldering surface 211 facilitated to be soldered with a cable (not shown). The retaining foot 24 resists the bottom of the front wall 111 of the first housing 1. The retaining portion 23 further defines a resisting portion 230 passing through the first receiving groove 115 and extending to the inner of the rear wall 112 of the first housing 1.

The shielding member 3 is stamped from a metal sheet, and comprises a base plate 31 and a front plate 32 extending vertically from the front side of the base plate 31. The shielding member 3 encloses the periphery of the first housing 1, the base plate 31 and the front plate 32 respectively define a plurality of cavities 322 and a pair of locking ears 311 respectively corresponding to the wedges 114 and the protrusions 1120. The front plate 32 defines a pair of curved retaining sheets 321 spaced disposed between adjacent two cavities 322, and each retaining sheet 321 has an V-shaped retaining portion 3210. The base plate 31 defines a pair of S-shaped finger portions 312 respectively extending downwardly from the two distal ends of thereof and disposed between the locking ears 311 and the front plate 32, and the finger portions 312 respectively extend into and are received in the windows 117. The base plate 31 defines a plurality of dents 314 adjacent to the rear side thereof and along the longitudinal direction, the dents 314 further have a plurality of grounding pads 314 for connecting with conductive portions (not shown) of a cable (not shown).

In the process of assembling the first connector 100, firstly, the first terminals 2 are respectively received in the corresponding first receiving slots 115 of the first housing 1. The retaining foots 24 of the first terminals 2 are retained by the bottom of the front wall 111 of the first housing 1, and the retaining portions 23 of the first terminals 2 are retained in the rear wall 112 of the first housing 1 and further pass through the rear wall 112. Then, the shielding member 3 encloses the periphery of the first housing 1 with the windows 322 and locking sheet 311 respectively engaging with the wedges 114 and the protrusions 1120 and the slits 1121, the finger portions 312 of the shielding member 3 passing through the windows 117 of the first housing 1 and extending out.

Figure 6:
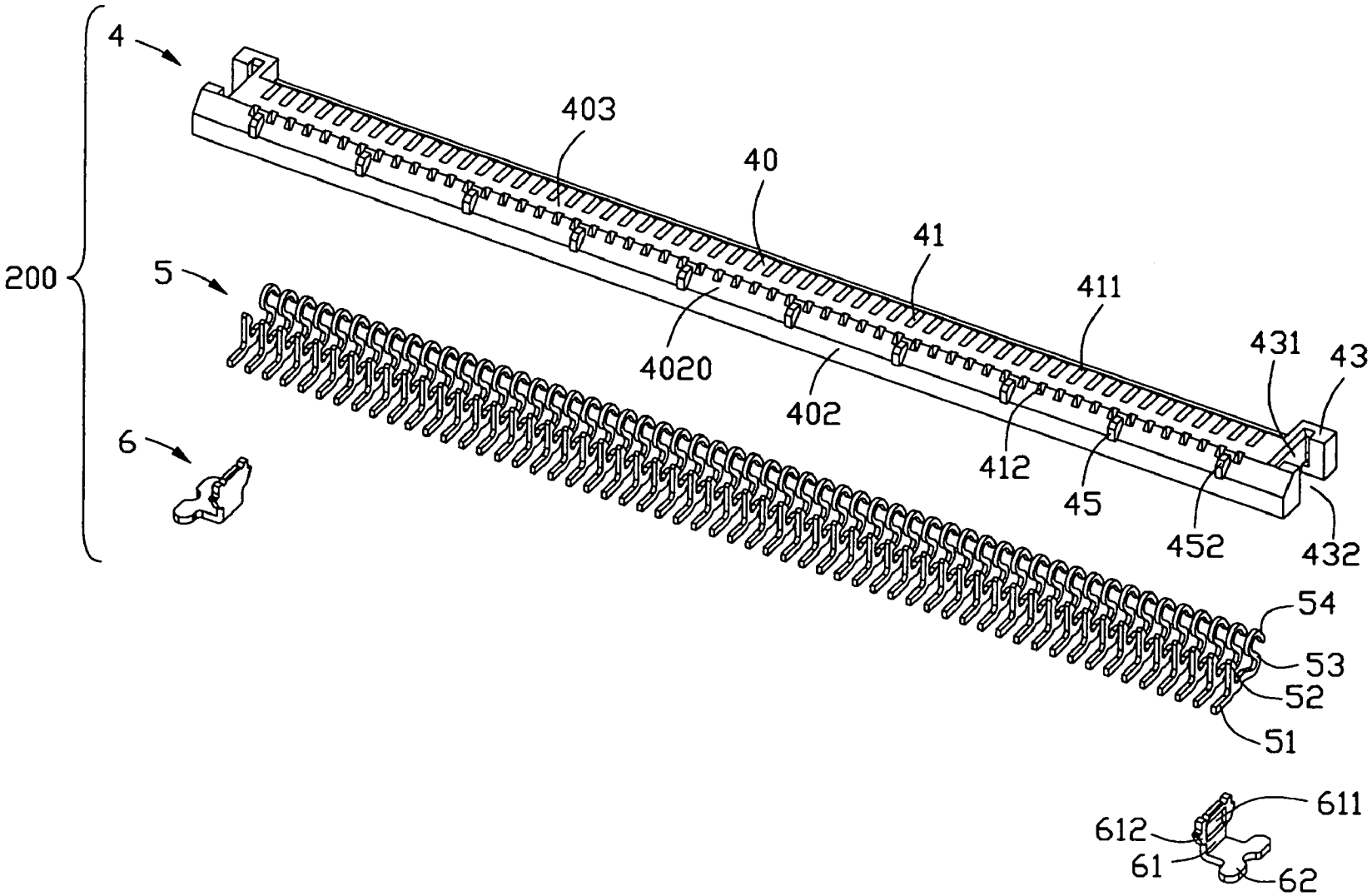
FIG. 6 is an exploded, perspective view of the second connector shown in FIGS. 2 and 3.
Figure 7:
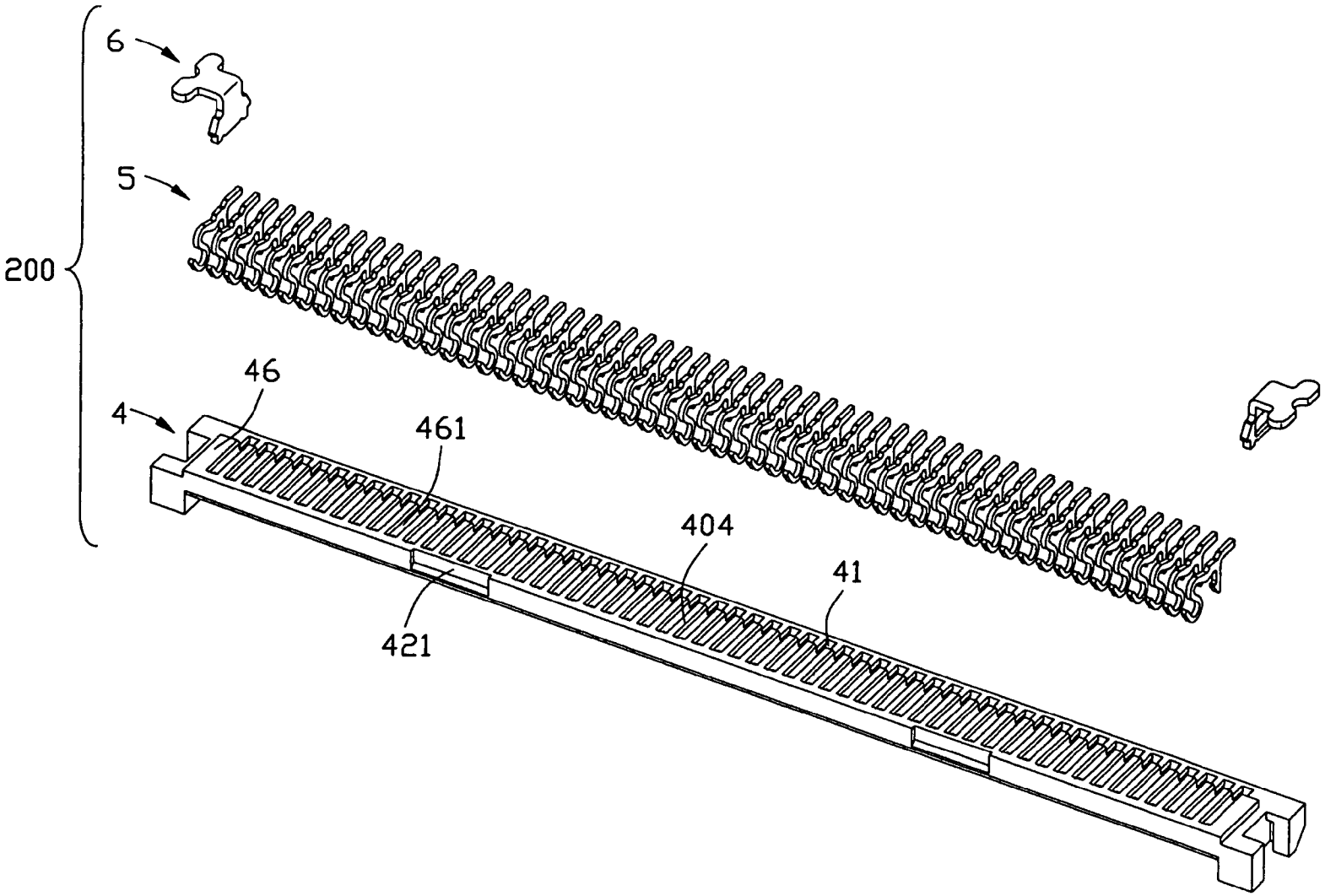
FIG. 7 is a view similar to FIG. 6, but taken from a different aspect.

Referring to FIGS. 6-7 and in conjunction with FIGS. 2-3, the second connector 200 comprises a second housing 4, a plurality of second terminals 5 received in the second housing 4 and a pair of grounding members 6 assembled to two sides of the second housing 4.

The second housing 4 extending along longitudinal direction, comprises a base 40, a retaining wall 42 (FIG. 2) located on the front end of the base 40 and a pair of end portions 43 disposed at two side of the base 40. The base 40 comprises a front face 401, a rear face 402 opposite to the front face 401, an upper face 403 and a lower face 404 opposite to the upper face 403. The base 40 defines a plurality of second receiving slots 41 extending downwardly from the upper face 403 to lower face 404 and aligned longitudinally, and each second receiving slot 41 comprises a first receiving portion 411 and a second receiving portion 412 communicating with the first receiving portion 411 by the lower face 404. The lower face 404 further defines a supporting board 46, and the supporting board 46 defines a plurality of channels 461 corresponding to the second receiving slots 41. Each end portion 43 forms a groove 431 extending from the upper face 403 to the lower face 404 and an opening 432 communicating with the groove 431 along the transversal direction. The front face 401 and the retaining wall 42 together define a receiving portion 44 for receiving the projection 1111 of the front wall of the first housing 1. The retaining wall 42 defines at least a retaining groove 421 engaging with the retaining sheet 321 of the shielding member 3. The jointing portion of the rear face 402 and the upper face 403 forms a bevel 4020 being of 45 degrees, and the bevel 4020 forms a plurality of engaging portions 45 engaging with the receiving sections 116 of the first housing 1. In preferred embodiment, the engaging portions 45 are substantially rectangular noses, and each comprises a detaining portion 451 (FIG. 8) projecting out of the rear face 402 and a sliding plane 452.

Each second terminal 5 comprises a second soldering portion 51, a locking portion 52 extending upwardly from the soldering portion 51, an S-shaped resilient portion 53 extending forwardly form the second soldering portion 51 and a contacting portion 54 extending forwardly and bending downwardly from the free end of the resilient portion 53. The soldering portion 51 and the contacting portion 54 are respectively located at two sides of the locking portion 52. The locking portion 52 further defines a stab 520 (FIG. 9) projecting from one side thereof and interferentially engaging with the second receiving channel 412 of the second receiving slot 41.

Each grounding member 6 is substantially of L-shape, and comprises a body 61, a pair of ear portions 612 with locking barbs thereon extending outwardly from the two sides of the body 61 and a tail portion 62 extending vertically and bifurcated horizontally from the body 61. The body 61 further defines a depressing portion 611 recessed from the outside thereof.

In the process of assembling the second connector 200, firstly, the second terminals 5 are assembled into the second housing 4 with the stabs 520 of the locking portions 52 interferentially received in the second channels 412 of the second slots 41 of the second housing 4. The resilient portions 53 are received in the first channels 411 of the second slots 41. The contacting portions 54 project out of the second channels 411 and extend into the receiving portions 44. The soldering portions 51 extend out of the lower face 404 of the base 40 of the second housing 4 and are soldered with a print circuit board (not shown). The grounding members 6 respectively engage with the grooves 431 of the end portion 43 of the second housing 4 with a pair of ear portions 612 received in the groove 431, the depressing portions 611 exposed between the opening 432, the tail portions 62 extending out of the opening 432 and soldered with the print circuit board (not shown).

Figure 8:
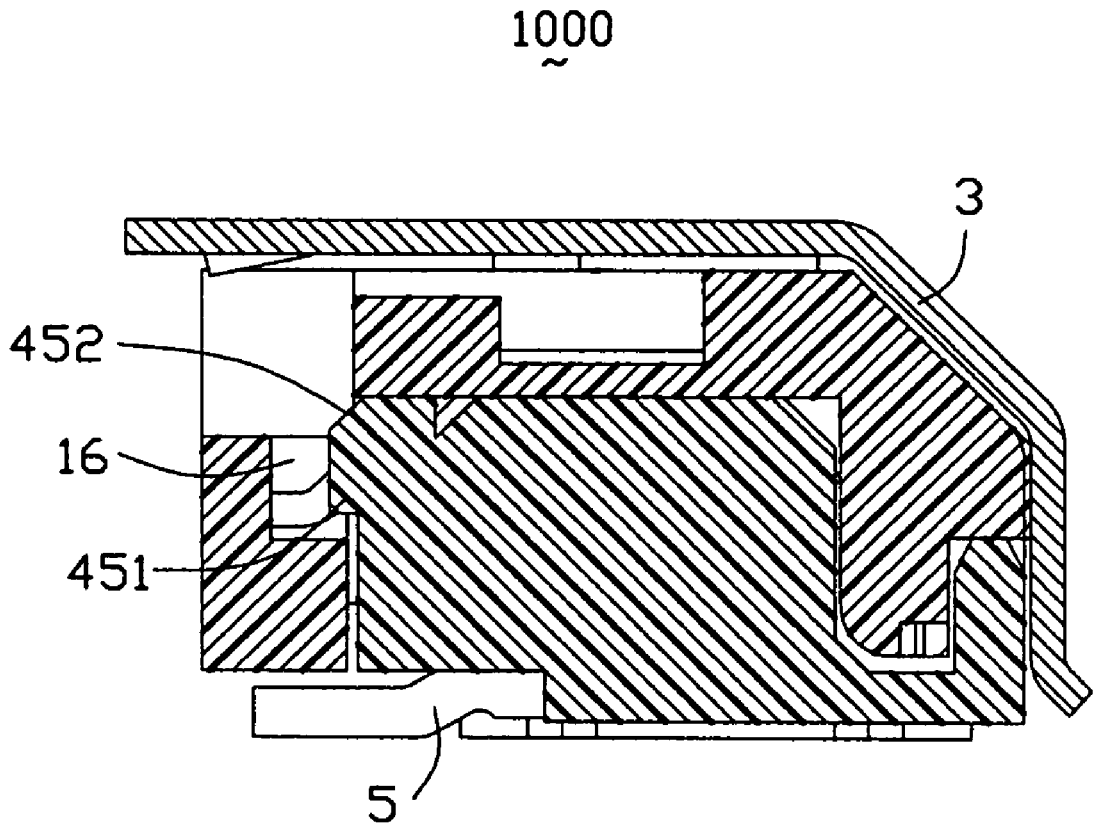
FIG. 8 is a cross-sectional view of FIG. 1 taken along line 8-8.
Figure 9:
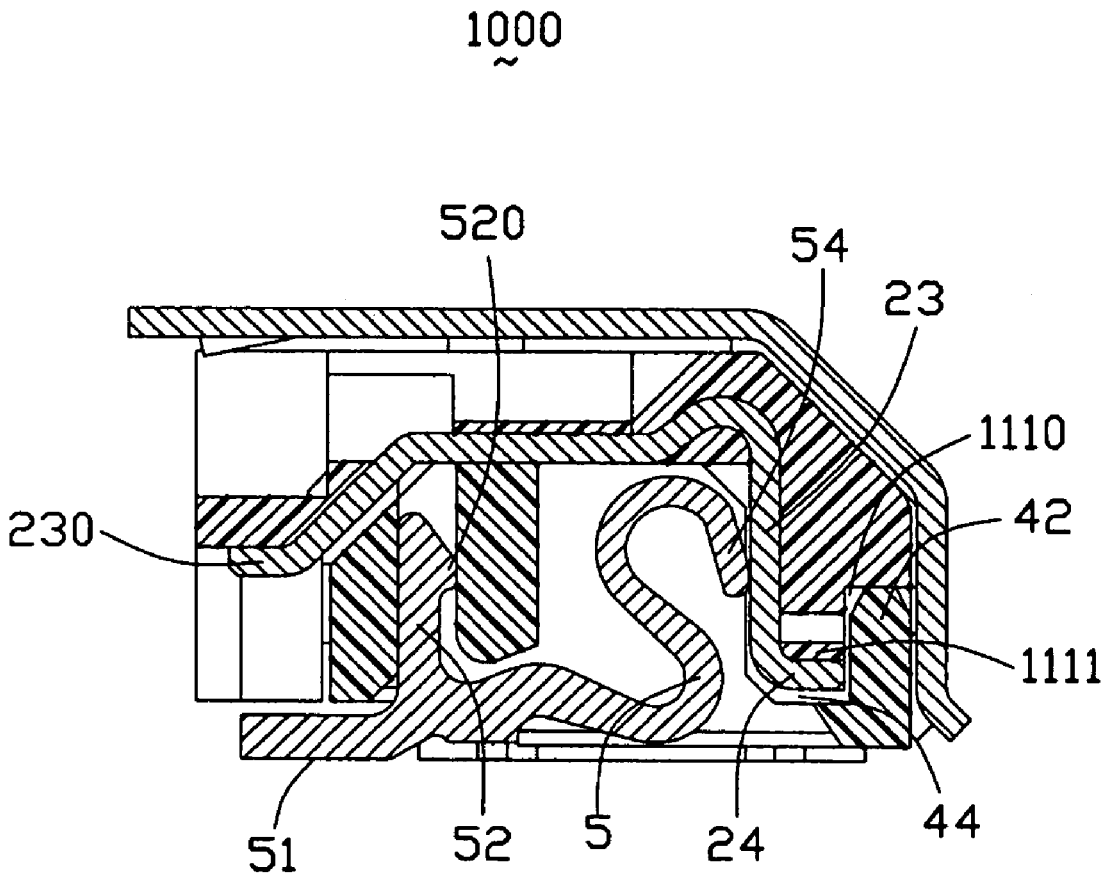
FIG. 9 is a cross-sectional view of FIG. 1 taken along line 9-9.

Referring to FIGS. 1-3 and in conjunction with FIGS. 8-9, in the process of assembling the electrical assembly 1000, the assembled first connector 100 will be assembled to the assembled second connector 200. Firstly, the first connector 100 is moved toward the second connector 200 from top thereof with the base 40 received in the receiving space 110 of the first housing 1. The recess 1110 and the projection 1111 of the first housing 1 respectively engage with the retaining wall 42 and the receiving portion 44 of the second housing 4, and the contacting portions 42 and the retaining foots 24 synchronously retain on the projection 1111 and together are received in the receiving portion 44 of the second housing 4. The end portions 43 are respectively received in the notches 13 of the first housing 1. The bottom face of the supporting board 46 is coplanar with the soldering portions 51 of the second terminals 5 for protecting the second terminals 5 from being destroyed. Then, continuously pressing the first connector 100 downwardly toward the second connector 200, the inner face of the rear wall 112 of the first housing 1 slides on the sliding plane 452, and then the engaging portions 45 are respectively received and detained in corresponding receiving sections 116 to prevent the first connector 100 from overturning from the second connector 200. After accomplishment of assembling the electrical connector assembly 1000, the contacting portions 54 of the second terminals 5 electrically engage with the mating portions 23, and the resilient portions 53 provide a resilient force to assure the reliable electrical connection between the contacting portions 54 and the mating portions 23. The shielding member 3 encloses the second connector 200 with the retaining portions 3210 engaged with the retaining grooves 421 of the retaining wall 42 of the second housing 4. The finger portions 312 of the shielding member 3 extend into the grooves 431 of the end portions 43 and resist against the depressing portions 61 of the grounding members 6 to establish a grounding connection. Thus, the electrical connector assembly 1000 according to present invention not only is capable of preventing the first connector 100 from overturning from the second connector 200 under an outside force, but also has a simple structure and easily assembling advantages.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly, comprising:

a first connector having a first housing and a plurality of first terminals fitted in the first housing, said first housing comprising a longitudinal main body, said main body includes a front wall, a rear wall opposite to front wall, and an upper wall connecting with the front wall and rear wall, wherein the front wall, rear wall, and the upper wall common defining a receiving space, a plurality of first receiving slots arranged along the longitudinal direction and formed in said receiving space for the first terminals received in, and the first receiving slots extending to the rear wall and communicating with the rear wall;

a second connector having a second housing and a plurality of second terminals fitted in the second housing, said second housing comprising a longitudinal base and a plurality of second receiving slots arranged along the longitudinal direction to receive the second terminals, and said base received in the receiving space of the first connector; and wherein the first housing comprises a plurality of receiving sections on the rear wall and disposed between the first receiving slots at intervals, the second housing of the second connector comprises a plurality of engaging portions arranged corresponding to the receiving sections, said engaging sections are received and retained in the receiving sections.

2. The electrical connector as claimed in claim 1, wherein the receiving sections are receiving slots, the engaging portions are substantially rectangular noses received in the receiving slots.

3. The electrical connector as claimed in claim 1, wherein the upper wall of the first housing defines a plurality of receiving passageways adapted for receiving cables, and said receiving passageways communicate with the receiving space in the upper wall.

4. The electrical connector as claimed in claim 1 wherein the receiving sections are receiving slots, the engaging portions are substantially rectangular noses and each nose comprises a detaining portion projecting out of the second housing, said detaining portions are detained in the receiving slots.

5. The electrical connector as claimed in claim 4, wherein the receiving slots extend the Y direction perpendicular to the X direction, the noses extend along the direction perpendicular to X direction either, and the receiving slots and the noses mate with each other along the Z direction.

6. The electrical connector as claimed in claim 4, wherein the each engaging portion further defines a sliding plane facilitating to the assembly between the detaining portion and the receiving slot.

7. The electrical connector as claimed in claim 1, wherein each first terminal is substantially L-shaped and comprises a soldering portion extending horizontally, a mating portion extending downwardly, a retaining foot bending horizontally and extending forwardly from the mating portion and a retaining portion bending obliquely and extending rearward from the soldering portion.

8. The electrical connector as claimed in claim 7, wherein each second receiving slot comprises a first receiving channel and a second receiving channel communicating with the first receiving channel by the bottom of the second housing.

9. The electrical connector assembly as claimed in claim 8, wherein each second terminal comprises a soldering portion extending out of the second housing for soldering with a print circuit board, a locking portion extending upwardly from the soldering portion, a substantial S-shaped resilient portion extending forwardly form the soldering portion and a contacting portion extending forwardly and bending downwardly from the free end of the resilient portion, the soldering portions and the contacting portions are respectively located at two sides of the locking portions.

10. The electrical connector as claimed in claim 9, wherein the locking portions are interferentially received in the second channels of the second receiving slots, the resilient portions are received in the first channels of the second receiving slots.

11. The electrical connector as claimed in claim 9, wherein the resilient portions of the second terminals respectively resist against the mating portions of the first terminals.

12. The electrical connector assembly as claimed in claim 9, wherein the second housing further defines a supporting board on the bottom thereof and having a plurality of channels communicating with the second receiving slots, and the soldering portions of the second terminals is coplanar with the bottom of the supporting board.

13. The electrical connector as claimed in claim 1, further comprising a shielding member enclosing the first housing, and said shielding member further engaging with the second housing when the electrical connector assembly is assembled.

14. The electrical connector as claimed in claim 13, wherein the shielding member further comprises a base plate covering the top of the first housing and a front plate extending vertically from the front side of the base plate and covering the front wall and the front portion of the second housing.

15. The electrical connector as claimed in claim 14, wherein the base plate has a pair of S-shaped finger portions respectively extending downwardly from the two distal ends of thereof.

16. The electrical connector as claimed in claim 15, wherein further comprising a pair of grounding members disposed at two sides of the second housing, the finger portions of the shielding member engage with the grounding members to establish an electrical connection when the electrical connector assembly is assembled.

17. An electrical connector assembly comprising:

a first connector including a first insulative housing defining a downward receiving cavity;

a plurality of first contacts disposed in the first housing with first contact portions exposed to the receiving cavity;

a second connector including a second insulative housing with a center portion received in the receiving cavity;

a plurality of second contacts disposed in the second housing with second contact portion mechanically and electrically engaged with the corresponding first contacts;

a plurality of protrusions formed on an exterior face of a left side wall of the second housing;

a plurality of recesses formed in an interior face of a left side wall of the first housing which abuts against the left side wall of the second housing; wherein the protrusions are respectively received in the corresponding recesses; wherein the first connector further include a metallic shell enclosing the first housing, and said second housing further includes a right side wall sandwiched between a right side wall of the first housing and said metallic shell.

18. The electrical connector as claimed in claim 17, wherein the first contact are adapted to be connected to a cable which extends around the left side wall of the first housing, and the second contacts are adapted to be soldered to a printed circuit board around the left side wall of the second housing.

19. An electrical connector assembly comprising:

a first connector including a first housing having a base wall, a pair of first side walls upwardly extending from an opposite edges of the base wall along first direction, and a pair of second side walls vertical extending from either opposite edges of the base wall along a second direction vertical to the first direction, the base wall and the first and second side walls common defines a receiving space, and a plurality of receiving slots being fanned on the second side walls;

a plurality of first terminals received in corresponding receiving slots, each is substantially L-shaped and comprises a soldering portion extending horizontally, a mating portion extending downwardly, a retaining foot bending horizontally and extending forwardly from the mating portion and a retaining portion bending obliquely and extending rearward from the soldering portion;

a second connector including a second housing having a corresponding portion received in the receiving space;

a second terminals disposed in the second housing and electrically engaging with the corresponding first terminals;

wherein the rear wall of the first housing defines a plurality of receiving section between the first receiving slots, and the second housing defines a plurality of protrusions engaging with the receiving section.

* * * * *